US006685493B2

(12) United States Patent
Birkenmaier et al.

(10) Patent No.: US 6,685,493 B2
(45) Date of Patent: Feb. 3, 2004

(54) ELECTRIC CONNECTOR

(75) Inventors: Gerhard Birkenmaier, Meckenbeuren (DE); Henrik Schuh, Friedrichshafen (DE)

(73) Assignee: ZF Friedrichshafen AG, Friedrichshafen (DE)

( * ) Notice: Subject to any disclaimer, the term of this patent is extended or adjusted under 35 U.S.C. 154(b) by 0 days.

(21) Appl. No.: 10/181,610

(22) PCT Filed: Jan. 23, 2001

(86) PCT No.: PCT/EP01/00688

§ 371 (c)(1),
(2), (4) Date: Jul. 18, 2002

(87) PCT Pub. No.: WO01/56118

PCT Pub. Date: Aug. 2, 2001

(65) Prior Publication Data

US 2003/0013338 A1 Jan. 16, 2003

(30) Foreign Application Priority Data

Jan. 29, 2000 (DE) ..... 100 03 924

(51) Int. Cl.[7] ..... H01R 13/213
(52) U.S. Cl. ..... 439/314; 439/562
(58) Field of Search ..... 439/314–319, 439/562, 565

(56) References Cited

U.S. PATENT DOCUMENTS 5,141,448 A * 8/1992 Mattingly et al. ..... 439/314
5,662,488 A 9/1997 Alden ..... 439/314
5,722,847 A * 3/1998 Haag ..... 439/320
6,203,349 B1 * 3/2001 Nakazawa ..... 439/319
6,226,068 B1 * 5/2001 Arcykiewicz et al. ..... 439/314

FOREIGN PATENT DOCUMENTS

| | | |
|---|---|---|
| DE | 198 30 672 A1 | 1/2000 |
| DE | 199 03 712 A1 | 8/2000 |
| EP | 0 893 856 A2 | 1/1999 |
| GB | 2 043 369 | 10/1980 |
| GB | 2 155 985 A | 10/1985 |

* cited by examiner

*Primary Examiner*—Gary Paumen
(74) *Attorney, Agent, or Firm*—Davis & Bujold, PLLC

(57) ABSTRACT

Electrical plug-in connector (1) for establishing an electric connection through a housing wall, especially the wall of a motor vehicle gearbox, with a pin housing (2) containing an electric plug contact (4) and a guide sleeve (3) that is detachably connected with it through a bayonet catch (7, 8), wherein the pin housing (2) is basically arranged on the interior, and the guide sleeve (3) basically on the exterior of the housing wall, and the pin housing (2) contains an inner and an outer substantially circular collar (5, 6) on its end facing the guide sleeve (3). A bayonet fitting (8) is arranged on the exterior of the guide sleeve (3), and the locking pins (7) corresponding to the fitting (8) are arranged on the interior of the outer collar (6) of the pin housing (2).

12 Claims, 5 Drawing Sheets

ELECTRIC CONNECTOR

FIELD OF THE INVENTION

The invention relates to an electrical plug-in connector for establishing an electrical connection through a housing wall, in particular the wall of a motor vehicle gearbox. Such connectors contain at least one pin housing equipped with electrical plug contacts and one guide sleeve that can be detachably connected with the housing through a bayonet catch, wherein the pin housing is arranged largely on the inside and the guide sleeve largely on the outside of the housing wall. The plug connector can be fixed in a bushing of the housing wall and on the pin housing an inner and an outer, basically circular, collar are formed on the end facing the guide sleeve.

BACKGROUND OF THE INVENTION

Electrical plug-in connectors of the above-described kind are used for example for the electrical connection of gearbox controls in motor vehicles. Here generally a mechatronics module is arranged in the gearbox housing for converting electrical signals into mechanical motion. The mechatronics module is connected via the electrical plug-in connector with the housing exterior such that, for example, a connection can be established from the plug connector to the electric equipment of the motor vehicle via a cable.

An electrical plug-in connector of the above kind is known for example from DE 199 03 712 by the applicant. The electric plug connector described there consists among other things of a pin housing, which contains the contact pins, and a guide sleeve. Both parts can be connected with each other via a bayonet catch.

A similar plug connector is known from DE 198 30 672 by the applicant. The plug connector described in this document contains on one hand support elements that are arranged on the guide sleeve and are placed onto the exterior wall. A locking means is provided on the inside of the housing wall, which provides tension between the pin housing and the guide sleeve and/or the housing wall.

Such plug-in connectors are subject to constant development since for example the assembly of the pin housing and the mechatronics module is relatively difficult to perform in the gearbox housing because the electrical plug-in connector penetrates the generally vertical housing wall in a horizontal direction and the mechatronics module is assembled in the vertical direction. This creates not only a great risk of the contact pins being damaged during assembly of the connection, but on the other hand the individual components are continuously improved and simplified so that they can be produced more economically and are easier to assemble.

It is therefore the object of the present invention to provide a simple, cost effective as well as technically safe and easily assembled solution of an electrical plug-in connector. In doing so, it must be taken into consideration that the plug-in connector in the assembled state takes on a substantially horizontal position in the gearbox housing, wherein the housing wall generally runs vertically, and that assembly on the mechatronics module arranged in the gearbox housing usually occurs in the vertical direction. Here as well the pin housing is preferably connected with the mechatronics module so as not to be able to detach.

The above-mentioned object is accomplished with the features provided in the independent claims 1 through 3. Further beneficial embodiments are provided in the dependent claims.

SUMMARY OF THE INVENTION

Pursuant to the invention, an electrical plug-in connector of the described kind contains a bayonet catch between the pin housing and the guide sleeve, wherein the bayonet fitting is arranged on the exterior of the guide sleeve and the locking pin corresponding to this fitting on the interior of the outer collar of the pin housing. This way it is accomplished beneficially in contrast to existing embodiments that the pin housing, which supports the contact pins, has a relatively simple design, and that the bayonet catch is now arranged in the guide sleeve, enabling a simpler and less expensive production of both components.

In an alternative embodiment of the invention, it is suggested that the bayonet catch is arranged on the interior of the guide sleeve and the corresponding locking pins are arranged on the exterior of the inner collar of the pin housing. In this way, a simple design of the pin housing is suggested, which also simplifies the production process due to the fact that the inherently expensive bayonet catch is incorporated in the guide sleeve.

Another beneficial embodiment of the electrical plug-in connector provides for the bayonet catch to be arranged on the exterior of the inner collar of the pin housing and the corresponding locking pins on the interior of the guide sleeve.

In a particularly beneficial embodiment of the plug-in connector, the guide sleeve contains another bayonet fitting on its end facing away from the pin housing for holding a socket-contact element. Such a socket-contact element, which is located on the exterior of the gearbox housing, for example a connection to the on board electrical equipment can be established via a cable.

The additional bayonet catch for connecting the plug-in connector with a socket-contact element is beneficially arranged on the exterior of the guide sleeve. This way the two bayonet catches on the guide sleeve can be produced in a cost-effective manner.

It is furthermore suggested that the pin housing and/or the guide sleeve and/or the above-mentioned socket-contact element are equipped with an axial stop and that the first or also both bayonet fittings contain no final snap-in locking position to the axial fastening of the components with one another. This is also a suggestion that enables the inexpensive production of the bayonet catches.

In a development of the invention it is suggested that a spring element, for example a leaf spring, is arranged between the pin housing and a mechatronics module. This is an inexpensive possibility to reduce the axial play between the plug-in connector and the module. This axial play is particular of benefit when a mechatronics module, which is undetachably connected with the pin housing, is inserted into the housing interior, wherein the module is assembled in a stationary manner with the gearbox housing and the connector in the housing wall. Due to the spring prestressing generated with the spring element, a flexible, yet resistant connection is created between the pin housing and the module.

The spring element beneficially takes on a circular or U-shaped design and is inserted into a ring groove on the front of the pin housing.

Since the pin housing is conventionally made of polymers, it is suggested that the spring element be incorporated in the housing bottom of the pin housing already during the molding process so that the spring element beneficially generates an axial force onto the corresponding end faces of the module in the assembled state.

In another embodiment of the invention it is suggested to provide a locking element for fastening the electrical plug-in connector on the housing wall of the motor vehicle gearbox. This locking element connects the electrical plug-in connector and the housing wall with each other in a form-locking and/or non-positive manner.

For example, corresponding peripheral circular collars, which can be connected with each other via at least one spring clip, are provided on the housing exterior wall and on the guide sleeve, wherein the spring clip or several spring clip elements can be slid onto the two corresponding collars in the radial direction.

BRIEF DESCRIPTION OF THE DRAWINGS

The invention will now be described, by way of example, with reference to the accompanying drawings in which.

DETAILED DESCRIPTION OF THE INVENTION

Figure 1:
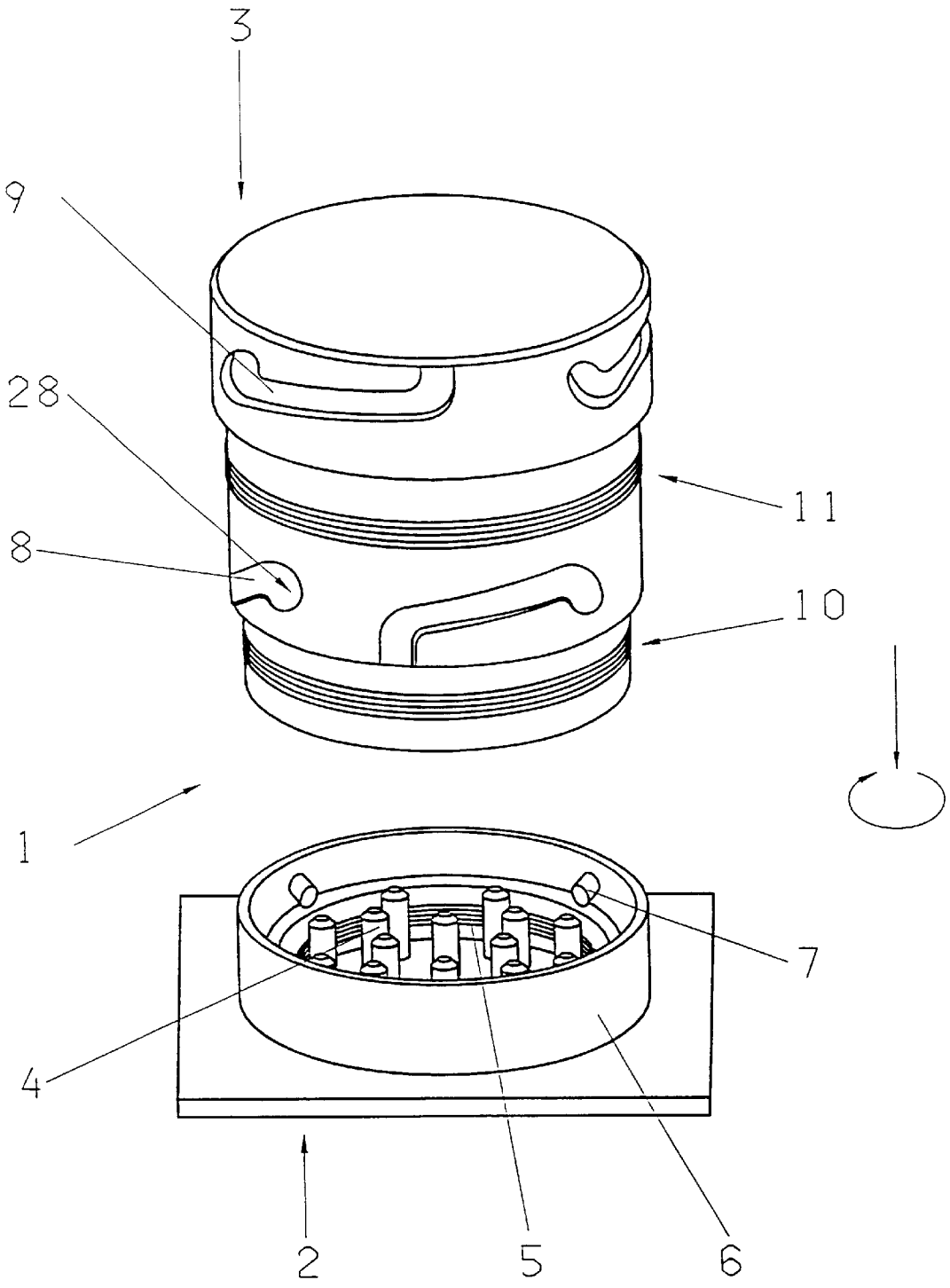
FIG. 1 a first embodiment pursuant to the invention of an electric plug-in connection in diagrammatic view.
Figure 4:
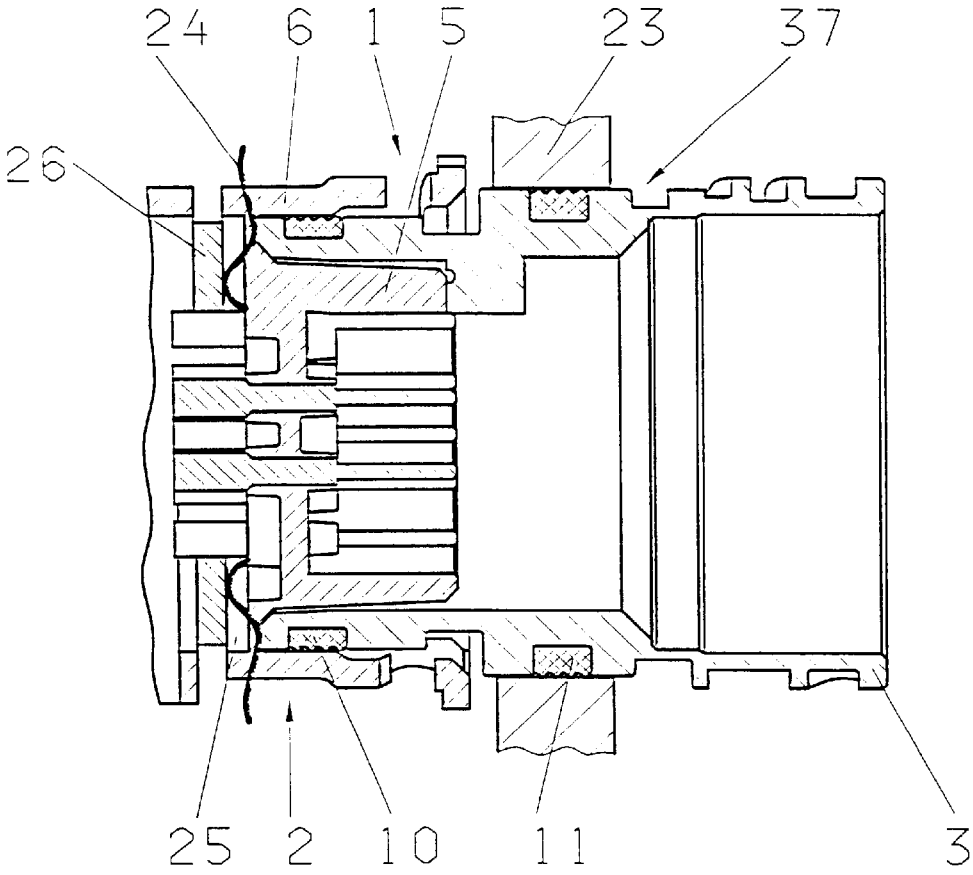
FIG. 4 a longitudinal section through an electrical plug-in connector pursuant to the invention in the assembled state with a spring element.

An electrical plug-in connector 1 (FIG. 1) pursuant to the invention consists basically of a pin housing 2 as well as a guide sleeve 3 that can be connected with said housing. The pin housing 2 contains two circular collars 5 and 6, which are arranged substantially concentrically to each other. In the interior space of the inner collar 5, plug contacts 4 are arranged and on the interior of the outer collar 6 radially arranged locking pins 7 are located for the purpose of locking the configuration with the bayonet catch 8 of the guide sleeve 3. In order to connect the guide sleeve 3 with the pin housing 2, the guide sleeve 3 is inserted into the pin housing 2 initially in a straight line in the direction of the two arrows and subsequently turned to the right so that the locking pins 7 snap into the final snap-in locking positions 28 of the first bayonet fitting 8. The bayonet fitting 8, as also the second bayonet fitting 9, can be designed without such final snap-in locking positions. On the exterior of the guide sleeve 3 furthermore two seal elements 10 and 11, for example in the form of sealing rings with multiple lips, are provided, which seal the guide sleeve 3 on one hand against the pin housing 2, and on the other hand against a housing wall 23 (see also FIG. 4).

Figure 2:
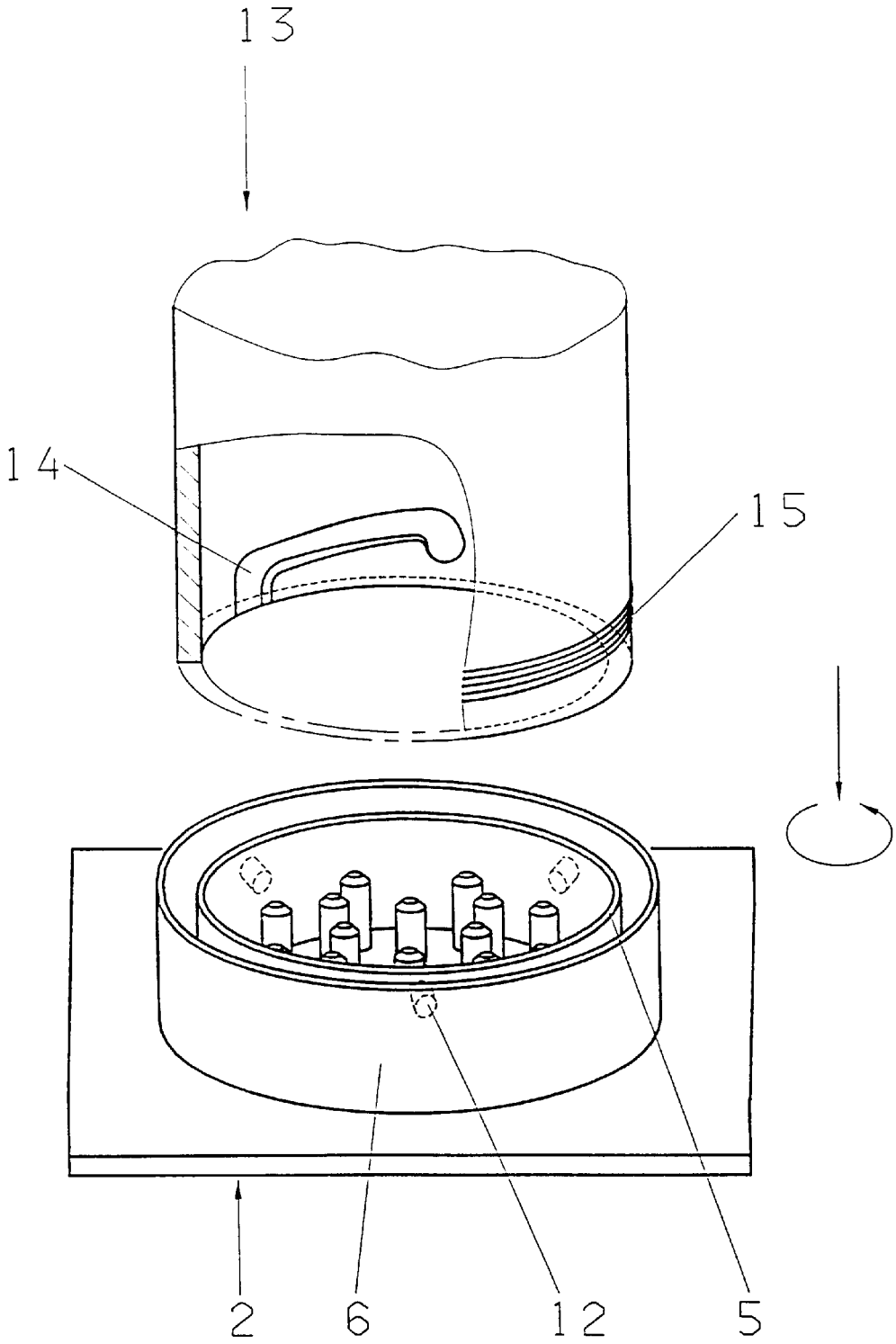
FIG. 2 a second embodiment pursuant to the invention of an electrical plug-in connector in diagrammatic view.
Figure 3:
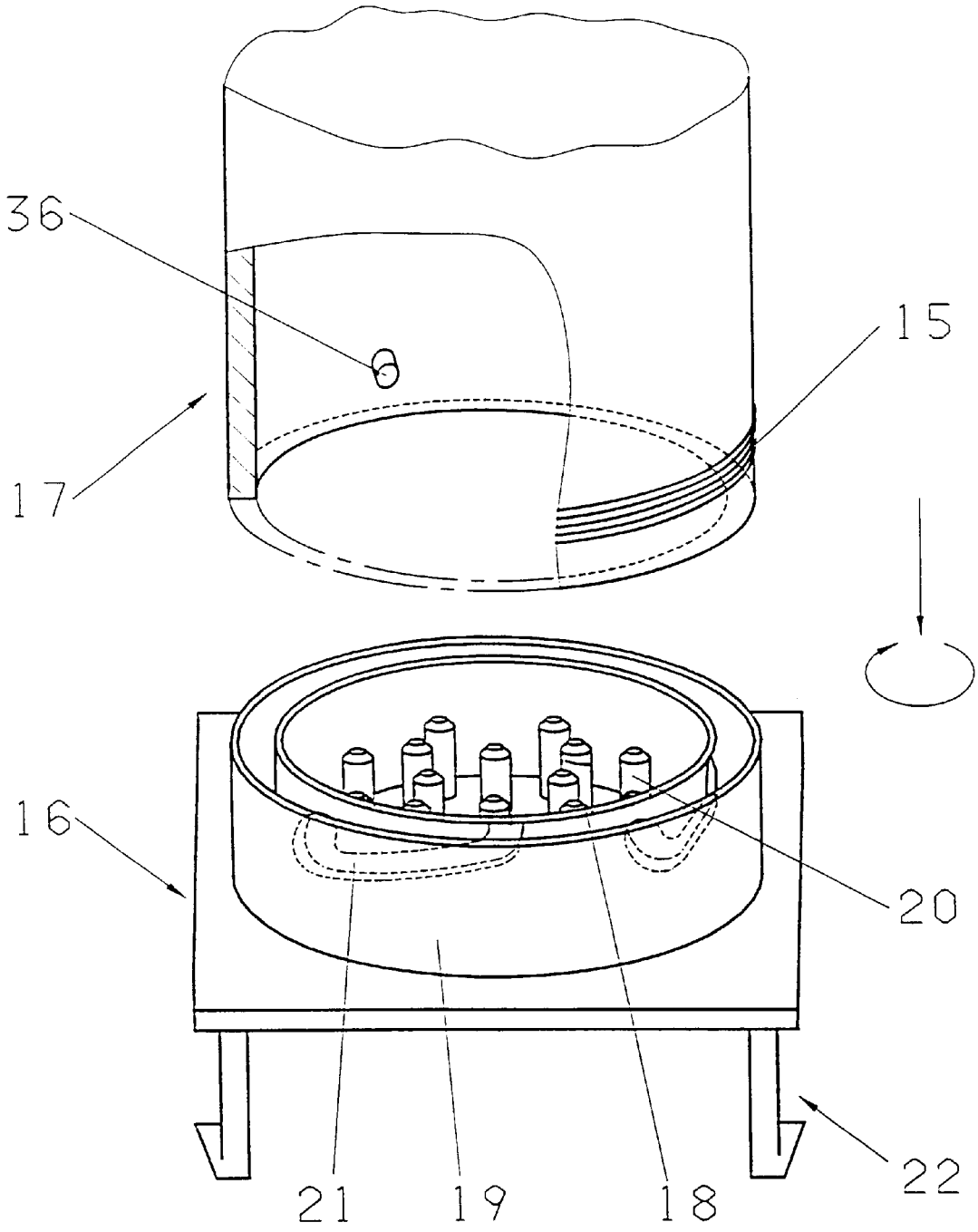
FIG. 3 a third embodiment pursuant to the invention of an electrical plug-in connector in diagrammatic view.

In an alternative embodiment of the electrical plug-in connector (FIG. 2) a pin housing 2 is connected with a guide sleeve 13 as follows: on the interior wall of the guide sleeve 13, the bayonet fitting 14 is arranged and the sealing ring 15 is arranged on the exterior wall. The fitting 14 corresponds to the locking pins 12 on the exterior of the inner collar 5 of the pin housing 2. Assembly of the guide sleeve 12 with the pin housing 2 occurs again based on the representation of the two arrows.

In another alternative embodiment of the electrical plug-in connector, the bayonet fitting 21 is now arranged on the exterior of the inner collar 18 of the pin housing 16. The plug contacts 20 are arranged in the interior of the inner collar 18. The locking pins 36 corresponding to the fitting are located on the inside of the guide sleeve 17. The plate sealing ring 15 is arranged on the exterior of the guide sleeve 17. Assembly again occurs in accordance with the direction of the arrow.

In the assembled state (FIG. 4) of the electrical plug-in connector 1, the pin housing 2 is arranged on the left or interior side of the housing wall 23, and the guide sleeve 3 basically on the right or exterior of the housing wall 23. The electrical plug-in connector 1 is passed through the opening 37 in the housing wall 23 and is sealed off against the housing wall 23 through seal elements 11. The sealing ring 10 seals the guide sleeve 3 against the pin housing 2. On the end face of the pin housing 2 facing the module 26, a ring groove 25 is incorporated, in which a spring element 24 is provided, which is molded into the pin housing bottom that is made, for example, of polymer. This spring element 24 generates an axial force that is applied onto the mechatronics module 26. This ensures a play-free connection between the module and the pin housing or the housing wall 23.

Figure 5:
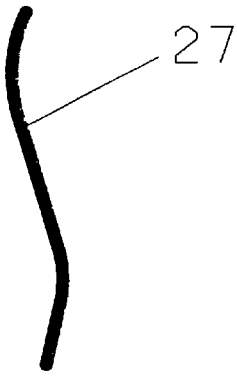
FIGS. 5/6 a spring element, similar to that in FIG. 4, in a top view and a side view, and FIG. 7 an electrical plug-in connector in the assembled state with a locking element for connection with a gearbox housing wall.
Figure 6:
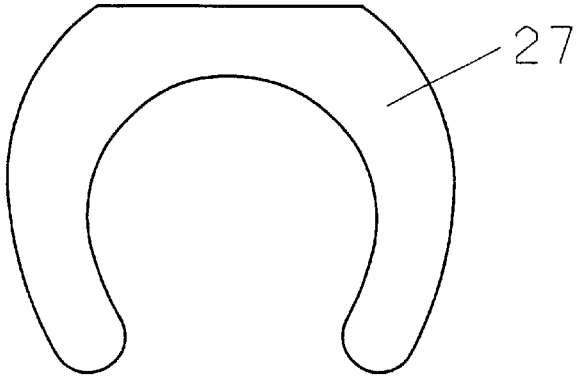

The above-described spring element can alternatively also be designed as a substantially U-shaped leaf spring 27 (FIG. 6). The leaf spring 27 in its side view (FIG. 5) exhibits an S-shape, causing the prestressing force between the two components that are to be assembled.

Figure 7:
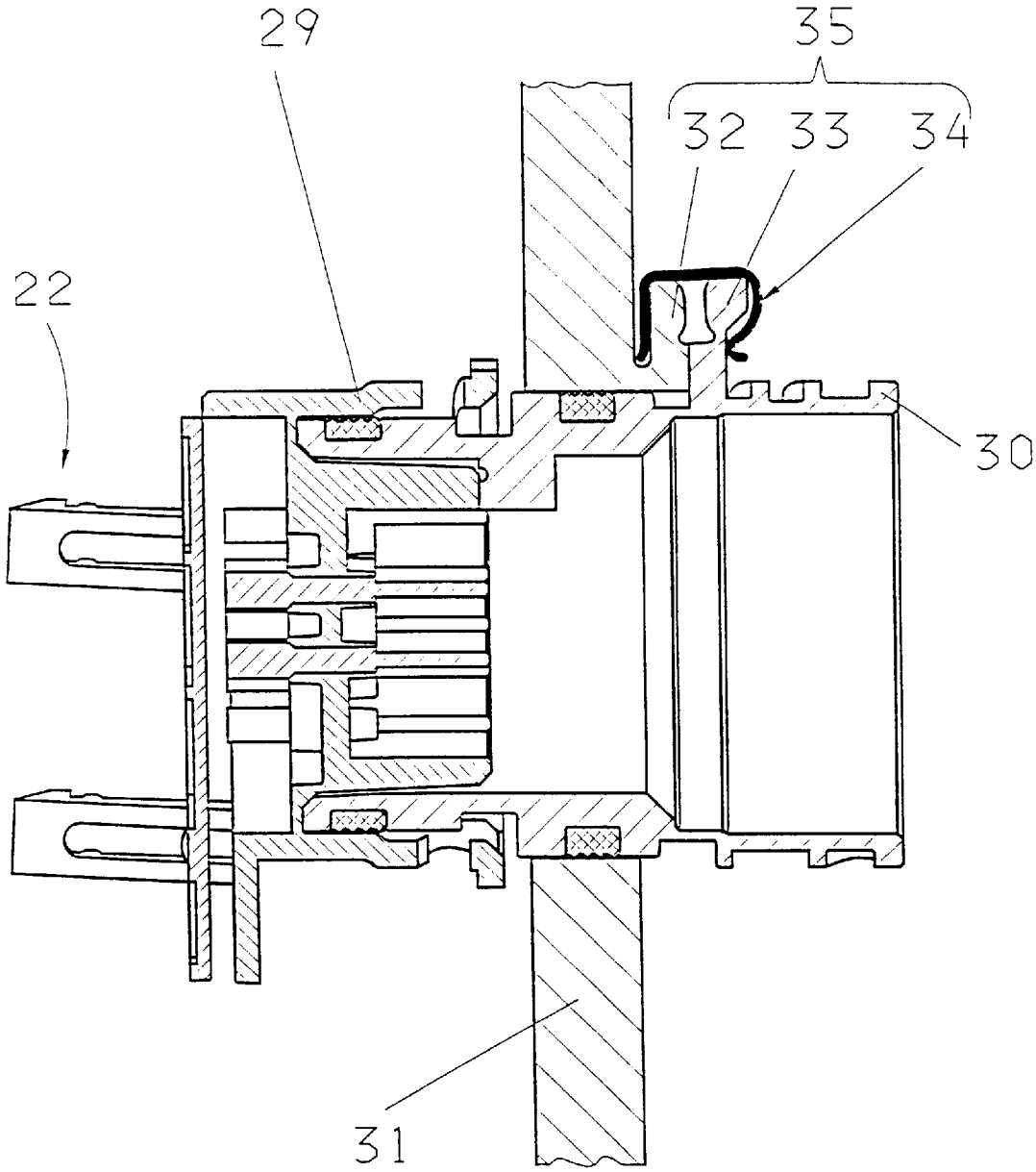

In another alternative embodiment (FIG. 7), a pin housing 29 as well as a guide sleeve 30 are shown in the assembled state in the housing wall 31. The guide sleeve 30 is connected with the housing wall 31 in an interlocking and non-positive detachable manner via a locking means 35. The locking means 35 consists, for example, of a collar-shaped snap-in element 32, which is located on the exterior of the housing wall 31. A corresponding collar-shaped snap-in element 33 is arranged on the exterior of the guide sleeve 30 such that both snap-in elements 32 and 33 can be connected detachably with each other via a spring clip 34.

Reference List

| | |
|---|---|
| 1 | electrical plug-in connector |
| 2 | pin housing |
| 3 | guide sleeve |
| 4 | plug contacts |
| 5 | inner collar |
| 6 | outer collar |
| 7 | locking pin |
| 8 | bayonet fitting |
| 9 | bayonet fitting |
| 10 | seal element/sealing ring |
| 11 | seal element/sealing ring |
| 12 | locking pin |
| 13 | guide sleeve |
| 14 | bayonet fitting |
| 15 | sealing ring |
| 16 | pin housing |
| 17 | guide sleeve |
| 18 | inner collar |
| 19 | outer collar |
| 20 | plug contacts |
| 21 | bayonet fitting |
| 22 | spring hook |
| 23 | housing wall |
| 24 | spring element |
| 25 | ring groove |
| 26 | mechatronics module |
| 27 | leaf spring |
| 28 | final snap-in locking position |

-continued

| Reference List |
|---|
| 29 pin housing |
| 30 guide sleeve |
| 31 housing wall |
| 32 collar |
| 33 collar |
| 34 spring clip |
| 35 locking means |
| 36 locking pin |
| 37 duct opening |

What is claimed is:

1. An electrical plug connector (1) for establishing an electric connection through a housing wall (23, 31), having an interior and an exterior, of a motor vehicle gearbox, with a pin housing (2, 16, 29) containing electric plug contacts (4, 20) and a guide sleeve (3, 13, 17) that is detachably connected with the pin housing through a bayonet fitting (8, 7), wherein the pin housing (2, 16, 29) is arranged on the interior of the housing wall and the guide sleeve (3, 13, 17) is on the exterior of the housing wall (23, 31), the pin housing containing inner and outer substantially circular collars (5, 6, 18, 19) on an end facing the guide sleeve (3, 13, 17), wherein the bayonet portion (14) of the fitting (8, 7) is arranged on one of the guide sleeve (3, 13, 17) and one of the circular collars (5, 6, 18, 19) while corresponding locking pins (12) of the fitting (8, 7) are arranged on the other of the guide sleeve (3, 13, 17) and one of the circular collars (5, 6, 18, 19).

2. The electrical plug connector according to claim 1, wherein the guide sleeve (3) on an end facing away from the pin housing (2) contains an additional bayonet fitting (9) for engaging a socket-contact element.

3. The electrical plug connector according to claim 2, wherein the additional bayonet fitting (9) is arranged on the exterior of the guide sleeve (3).

4. The electrical plug connector according to claim 1, wherein at least one of the pin housing, the guide sleeve and the socket-contact element contain an axial stop and at least one of the bayonet fittings (8, 9) contains no final snap-in locking position (28) for axial fastening of the components.

5. The electrical plug connector according to claim 1, wherein the pin housing (2) and a module (26) can be connected together by a spring element.

6. The electrical plug connector according to claim 5, wherein the spring element (24, 27) is inserted into a ring groove (25) of the pin housing (2).

7. The electrical plug connector according to claim 5, wherein the pin housing (2) is made of a polymer and that the spring element (24) is injection molded into the housing of the pin housing (2) so that the spring element (24) generates an axial force onto an end face of the module (26).

8. The electrical plug connector according to claim 1, wherein for fastening the electrical plug connector (1) to the housing wall (31) at least one locking means (35) is provided to connect the guide sleeve (30) and the housing wall (31) to each other in one of a position locking and friction-locking manner.

9. The electrical plug connector according to claim 8, wherein on the exterior of the housing wall (31), and on the guide sleeve (30), corresponding collar-shaped snap-in elements (32, 33) are provided, which are connected with each other.

10. The electrical plug connector according to claim 9, wherein the snap-in elements (32, 33) are connected with each other by at least one spring clip (34).

11. An electrical plug connector (1) for establishing an electric connection through a housing wall (23, 31), having an interior and an exterior, of a motor vehicle gearbox, with a pin housing (2, 16, 29) containing electric plug contacts (4, 20) and a guide sleeve (3, 13, 17) that is detachably connected with the pin housing through a bayonet fitting (8, 7), wherein the pin housing (2, 16, 29) is arranged on the interior of the housing wall, and the guide sleeve (3, 13, 17) is on the exterior of the housing wall (23, 31), the pin housing (2, 16, 29) being fastened in an opening (37) of the housing wall (23, 31) the pin housing containing inner and outer substantially circular collars (5, 6, 18, 19) on an end facing the guide sleeve (3, 13, 17), wherein a bayonet portion (8) of the fitting (8, 7) is arranged on one of the guide sleeve (3, 13, 17) and one of the circular collars (5, 6, 18, 19) while corresponding locking pins (7) of the fittings (8, 7), corresponding to the bayonet fitting (8), are arranged on the other of the guide sleeve (3, 13, 17) and one of the circular collars (5, 6, 18, 19).

12. An electrical plug connector (1) for establishing an electric connection through a housing wall (23, 31), having an interior and an exterior, of a motor vehicle gearbox, with a pin housing (2, 16, 29) containing electric plug contacts (4, 20) and a guide sleeve (3, 13, 17) that is detachably connected with the pin housing through a bayonet fitting (8, 7), wherein the pin housing (2, 16, 29) is arranged on the interior of the housing wall, and the guide sleeve (3, 13, 17) is on the exterior of the housing wall (23, 31), the pin housing (2, 16, 29) being fastened in an opening (37) of the housing wall (23, 31), the pin housing containing inner and outer substantially circular collars (5, 6, 18, 19) on an end facing the guide sleeve (3, 13, 17), wherein a bayonet portion (8) of the fitting (8, 7) is arranged on one of the guide sleeve (3) while corresponding locking pins (7) of the fittings (8, 7), corresponding to the bayonet sitting (8), are arranged on the other of the guide sleeve (3, 13, 17) on an inner surface of the outer circular collar (6).

* * * * *